US008505344B2

(12) United States Patent
Su

(10) Patent No.: US 8,505,344 B2
(45) Date of Patent: Aug. 13, 2013

(54) ROTATABLE LOCK FOR A PORTABLE ELECTRONIC DEVICE

(75) Inventor: Jason Su, Dingcuo Village (TW)

(73) Assignee: Ingamar Co., Ltd., Dingcuo Village, Lugang Township, Changhua County (TW)

( * ) Notice: Subject to any disclaimer, the term of this patent is extended or adjusted under 35 U.S.C. 154(b) by 105 days.

(21) Appl. No.: 13/042,338

(22) Filed: Mar. 7, 2011

(65) Prior Publication Data

US 2012/0227448 A1 Sep. 13, 2012

(51) Int. Cl.

| | |
|---|---|
| ***E05B 67/28*** | (2006.01) |
| ***E05B 73/00*** | (2006.01) |
| ***E05B 67/06*** | (2006.01) |
| ***E05B 27/00*** | (2006.01) |

(52) U.S. Cl.

USPC ..... 70/58; 70/14; 70/49; 70/491

(58) Field of Classification Search

USPC ..... 70/14, 18, 30, 49, 58, 490, 491, 493

See application file for complete search history.

(56) References Cited

U.S. PATENT DOCUMENTS

| | | | | |
|---|---|---|---|---|
| 4,546,629 | A * | 10/1985 | Hwang | 70/491 |
| 4,634,822 | A * | 1/1987 | Goeke | 200/43.08 |
| 5,327,752 | A * | 7/1994 | Myers et al. | 70/58 |
| 5,381,685 | A * | 1/1995 | Carl et al. | 70/58 |
| 6,463,770 | B1 * | 10/2002 | Lee | 70/58 |
| 6,886,376 | B2 * | 5/2005 | Kuo | 70/58 |
| 7,614,266 | B2 * | 11/2009 | White et al. | 70/58 |
| 2008/0168814 | A1 * | 7/2008 | Makino | 70/490 |

* cited by examiner

*Primary Examiner* — Suzanne Barrett
*Assistant Examiner* — Duoni Pan

(57) ABSTRACT

A rotatable lock for a portable electronic device includes a first casing, a second casing, two interlocking members, an I-shaped engaging member, a driving member, an elastic member and a lock core. The lock core is a depressible tubular lock having a limiting slot adjacent to an end and a key hole on another end. The key hole is an axial slot and has a plurality of protrusions and a positioning slot disposed in an inner wall, and a pivoted sliding rod. The key is a hollow column and has a positioning pin and a plurality of grooves. To unlock the lock, a positioning pin of the key needs to be aligned with the positioning slot of the key hole, and then the groove of the key engages with the protrusion of the key hole of the lock core such that the key is able to be rotated.

4 Claims, 15 Drawing Sheets

ROTATABLE LOCK FOR A PORTABLE ELECTRONIC DEVICE

BACKGROUND OF THE INVENTION

1. Field of the Invention

The present invention relates to a lock for a portable electronic device, and more particularly to a rotatable lock for a portable electronic device which provides an easy structure.

2. Description of the Related Art

Portable electronic devices are increasingly popular and important in modern life, providing significant convenience for users; however, these devices are also increasingly susceptible to pick pockets.

Therefore, various locks have been developed for these portable electronic devices, as shown in FIGS. 14 and 15. A prior art lock has: a lock 50, and a steel wire loop 60. The lock 50 comprises two opposing casings 51, a locking member 52, a number wheel set 53 and a control rod 54. On end of the opposing casings 51 is provided with the locking member 52 and another end is provided with the number wheel set 53. The number wheel set 53 comprises a plurality of number wheels 531, a plurality of ratchet 532, a spring 533, a spring plate 534, and a button 535; the number wheel set 53 is jacketed onto a predetermined position on the control rod 54. The flexible steel wire 60 is attached onto the casing 51, and another end of the steel wire is provided with a loop 61. First, the steel wire 60 is wrapped around a sturdy object, the lock 50 is passed through the loop 61 of the steel wire 60, and the locking member 52 is inserted into a corresponding aperture on the portable electronic device. Then, the number wheel set 53 is rotated to a desired combination number, the control rod 54 is pressed to engage the control rod 54 and the locking member 52 together, and then the lock 50 including the locking member 52 is rotated 90° to interlock the locking member 52 and the corresponding aperture of the portable electronic device. The user just needs to randomly change the indicated numbers on the number wheel set 53 to secure the portable electronic device.

However, the prior art lock has the following drawbacks: 1. In order to unlock the lock 50, a user needs to rotate the number wheel set 53, which requires a longer operating time. 2. The number wheel set 53 of the prior art lock requires a complicated manufacturing process, which leads to high costs. 3. The number wheel set 53 of the prior art lock is relatively heavy, and therefore is not very portable-friendly.

Therefore, it is desirable to provide a rotatable lock for a portable electronic device to mitigate and/or obviate the aforementioned problems.

SUMMARY OF THE INVENTION

An objective of the present invention is to provide a rotatable lock for a portable electronic device which provides an easy structure.

A rotatable lock for a portable electronic device, the lock comprising: a first casing, a second casing, at least two interlocking members, an I-shaped engaging member, a driving member, an elastic member and a lock core. The first casing has a cross-shaped opening on an end, the opening along a direction further provided with an engaging slot, a connecting section with a smaller cross-sectional area formed adjacent to another end, and the connecting section is provided with a through aperture; the second casing has a circular aperture at an end, a through aperture on a sidewall for accepting a positioning member, and a plurality of limiting openings at opposite sides of the side wall for engaging with corresponding stoppers on the at least two interlocking members; the I-shaped engaging member has a first T-shaped engaging end at an end and a second T-shaped engaging end at another end; the driving member is a disk having at least two parallel engaging pins on one side and a supporting slot on another side; the elastic member is a spring with a predetermined length; and the lock core is a depressible tubular lock having a limiting slot adjacent to an end and a key hole on another end; the key hole is an axial slot and has a plurality of protrusions and a positioning slot disposed in an inner wall, and a pivoted sliding rod; the sliding rod is provided with a protruding end at an end and a groove for accepting the spring at a middle section.

With the above-mentioned structure, the following benefits can be obtained:

1. The lock core of the lock is a depressible tubular lock, and therefore the key does not need to be rotated to unlock the lock.

2. Since the lock core of the lock is a depressible tubular lock, the lock has a simpler structure and a lighter weight.

3. To unlock, the positioning pin of the key is aligned with and inserted into the positioning slot of the key hole of the lock core, and the groove of the key is pushed against the protrusion of the key hole of the lock core such that the key can be rotated.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
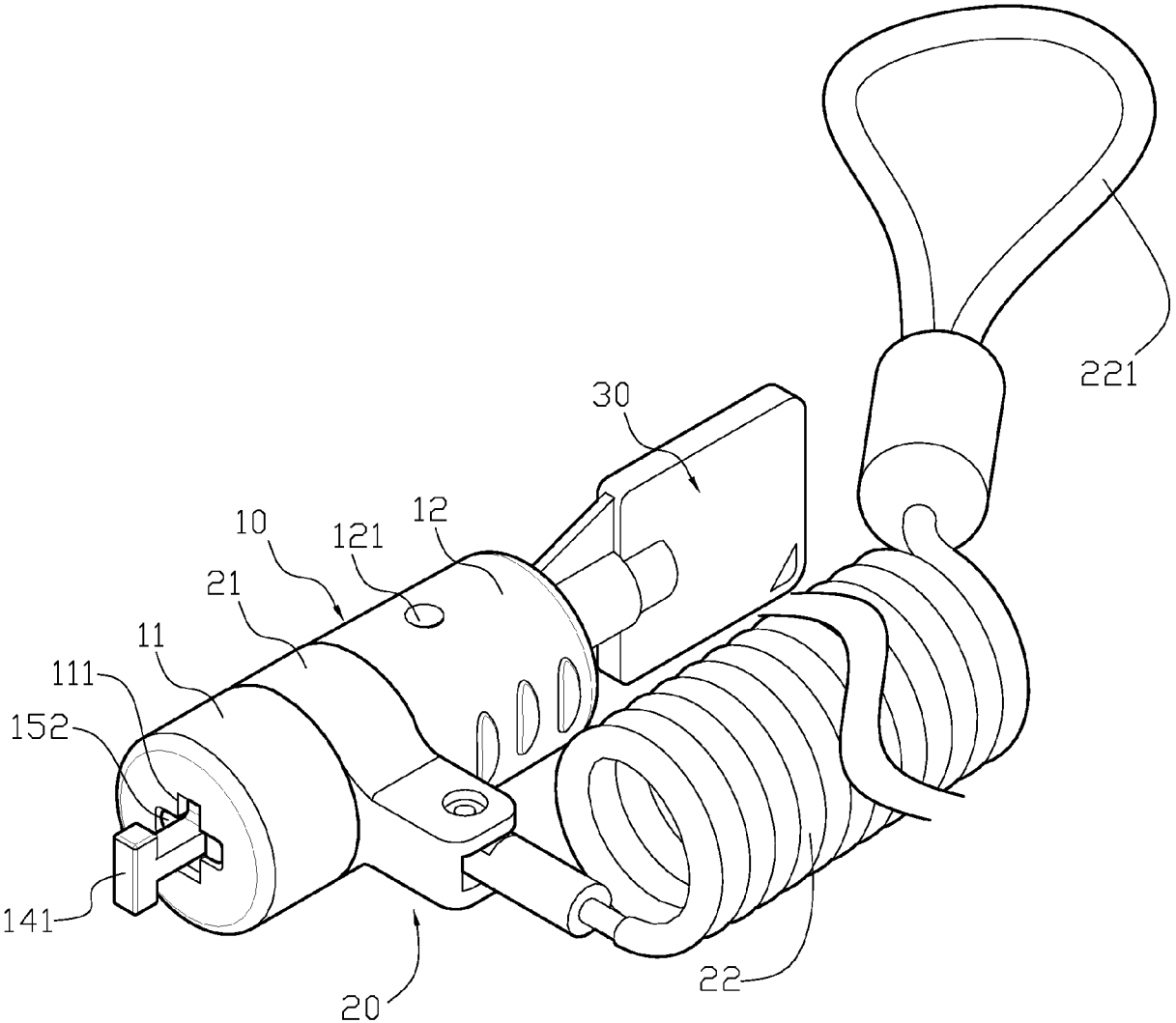
FIG. 1 is a perspective view of an embodiment of the present invention.
Figure 2:
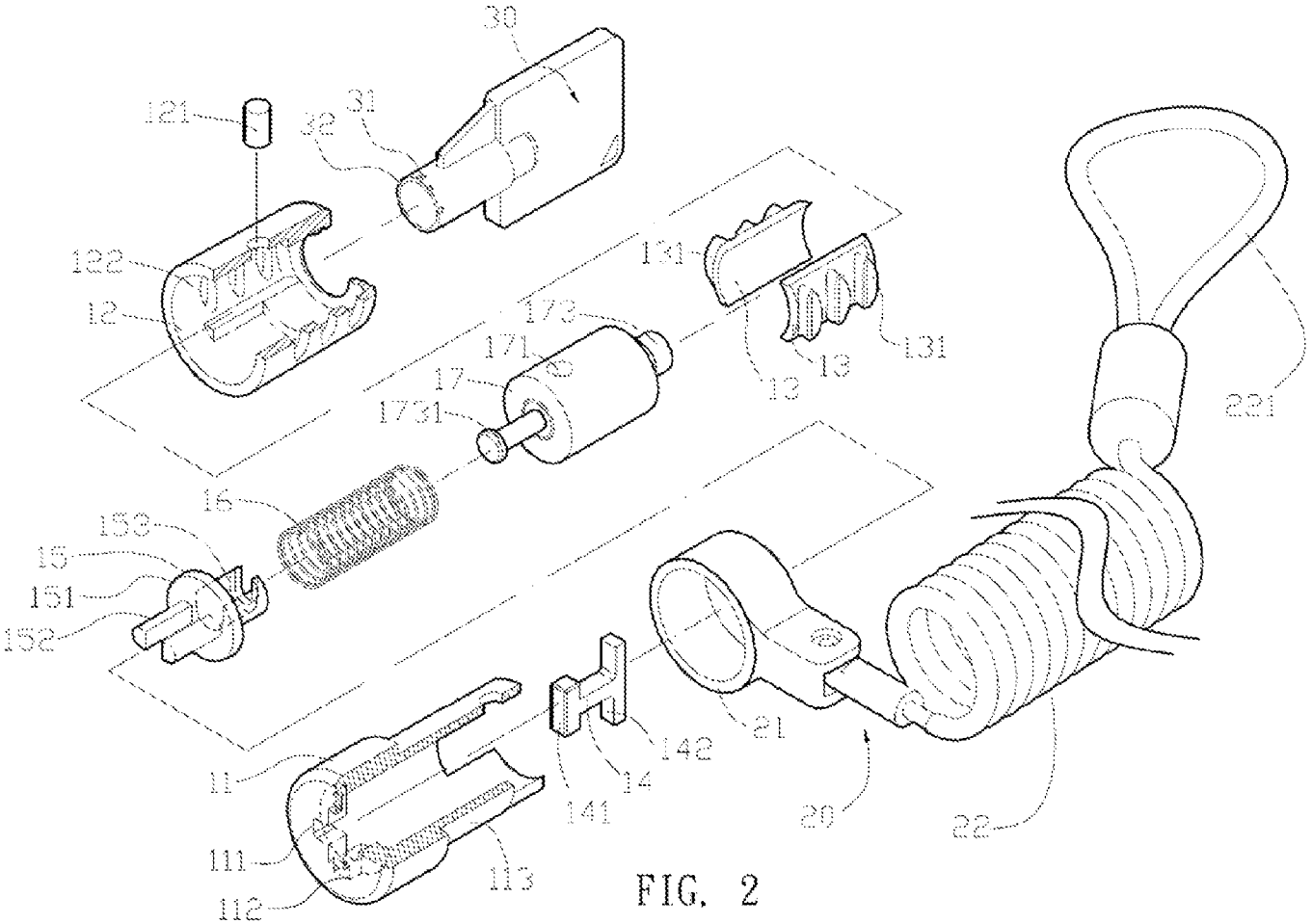
FIG. 2 is an exploded view of the embodiment of the present invention.
Figure 3:
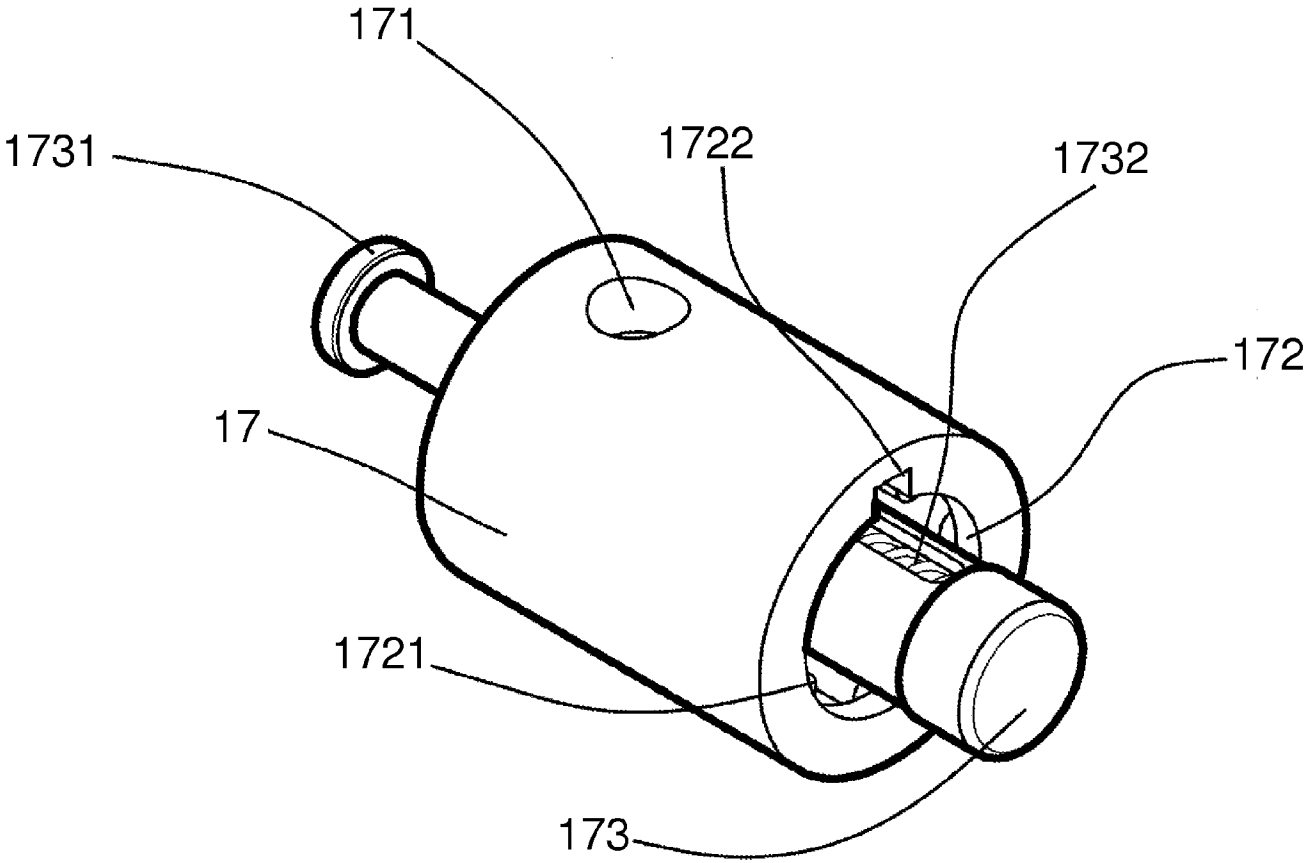
FIG. 3 is a schematic drawing of a lock core according to the embodiment of the present invention.

First, please refer to FIGS. 1 and 2 with FIG. 3. A rotatable lock for a portable electronic device, and the lock 10 is attached to a locking cable 20. The lock 10 comprise: a first casing 11, a second casing 12, at least two interlocking members 13, an I-shaped engaging member 14, a driving member 15, an elastic member 16 and a lock core 17. The first casing 11 has a cross-shaped opening 111 on an end, the opening 111 along a direction further provided with an engaging slot 112, a connecting section 113 with a smaller cross-sectional area is formed adjacent to another end, and the connecting section 113 is provided with a through aperture. The second casing 12 has a circular aperture at an end, a through aperture on a sidewall for accepting a positioning member 121, and a plurality pair of limiting openings 122 at opposite sides of the side wall for engaging with corresponding stoppers 131 on the at least two interlocking members 13. The I-shaped engaging member 14 is a rod having a high hardness and has a first T-shaped engaging end 141 at an end and a second T-shaped engaging end 142 at another end. The driving member 15 is a disk 151 having at least two parallel engaging pins 152 on one side and a supporting slot 153 on another side. The elastic member 16 is a spring with a predetermined length. The lock core 17 is a depressible tubular lock having a limiting slot 171 adjacent to an end and a key hole 172 on another end. The key hole 172 is an axial slot and has a plurality of protrusions 1721 and a positioning slot 1722 disposed in an inner wall, and a pivoted sliding rod 173. The sliding rod 173 is provided with a protruding end 1731 at an end and a groove for accepting a spring 1732 at a middle section. The locking cable 20 comprises a ring 21 and a steel cord 22. The steel cord 22 has a loop 221 at another end. The key 30 is a hollow column and has a positioning pin 31 and a plurality of grooves 32. With the above-mentioned structure, When the sliding rod 173 of the lock core 17 is pressed to the end, therefore the key 30 does not need to be rotated to unlock the lock 10. To unlock the lock 10, a positioning pin 31 of the key 30 needs to be aligned with the positioning slot 1722 of the key hole 172 of the lock core 17, and then the groove 32 of the key 30 engages with the protrusion 1721 of the key hole 172 of the lock core 17 such that the key 30 is able to be rotated. Therefore, the lock core 17 is unlocked and the sliding rod 173 is pushed back by the spring 1732.

Figure 4:
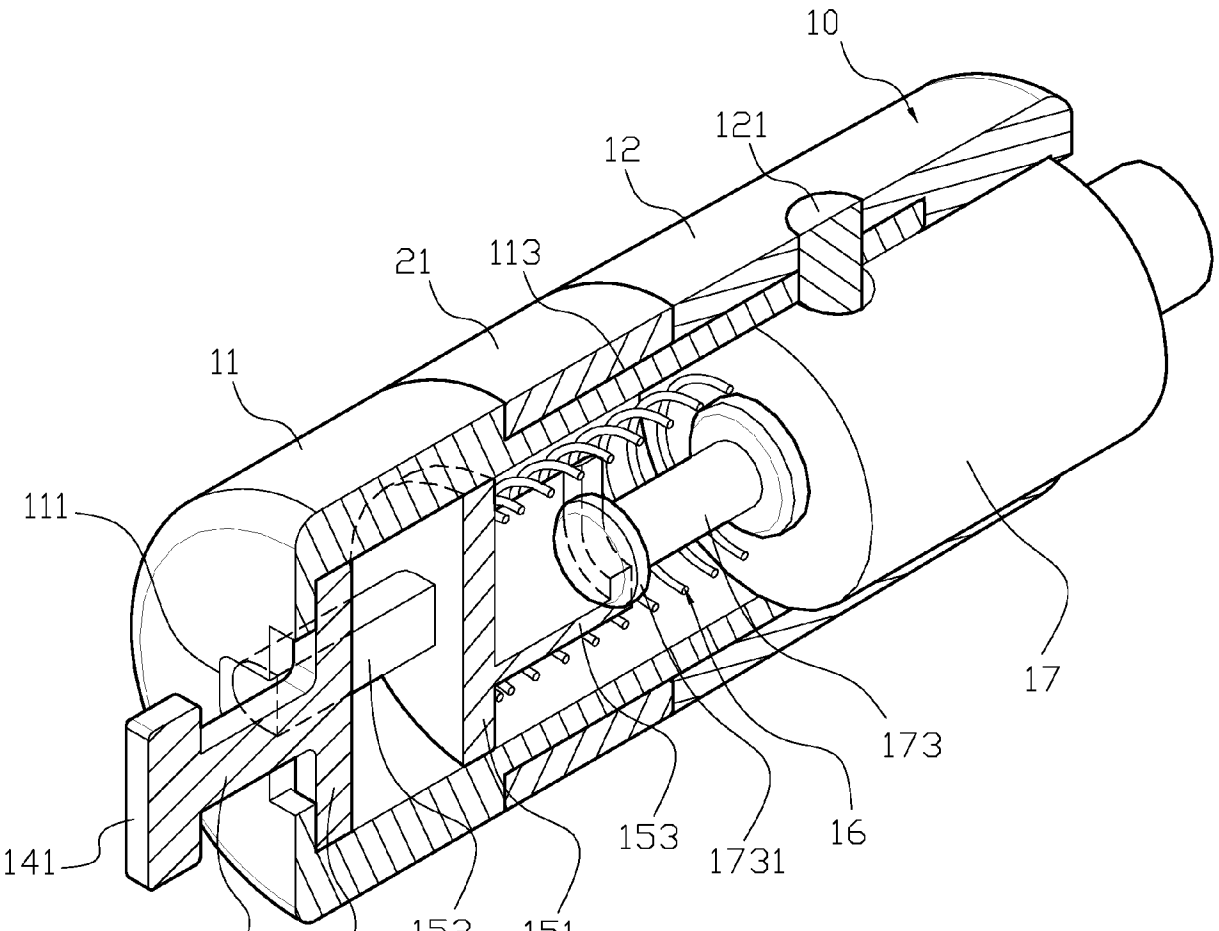
FIG. 4 is an assembly and cross-sectional drawing of the embodiment of the present invention.

For structural assembly, please refer to FIG. 2 and FIG. 4. The first T-shaped engaging end 141 of the I-shaped engaging member 14 is placed through the opening 111 of the first casing 11, and the second T-shaped engaging end 142 of the I-shaped engaging member 14 is engaged with the engaging slot 112 of the first casing 11. The connecting section 113 of the first casing 11 is jacketed with the locking cable 20 by way of the ring 21, such that the ring 21 of the locking cable 20 is capable of rotating around the connecting section 113 of the first casing 11. Furthermore, the sliding rod 173 of the lock core 17 is placed through the elastic member 16, and the protruding end 1731 of the sliding rod 173 of the lock core 17 is hooked onto the supporting slot 153 of the driving member 15, such that the elastic member 16 is compressed between the disk 151 of the driving member 15 and the lock core 17. The above-mentioned elements are all placed in the first casing 11, and the engaging pins 152 of the driving member 15 are placed through the opening 111 of the first casing 11 and form a cross with the I-shaped engaging member 14, such that the limiting slot 171 of the lock core 17 and the through aperture of the first casing 11 are aligned with each other. Moreover, the two stoppers 131 of the interlocking member 13 engage with the plurality of limiting openings 122 of the second casing 12, the second casing 12 is jacketed on to the connecting section 113 of the first casing 11 such that the through apertures of the first casing 11 and the second casing 12 are aligned with each other and the positioning member 121 is inserted into both of the through apertures. Last, the positioning member 121 is interlocked with the limiting slot 171 of the lock core 17 to secure the lock core 17. The lock core 17 of the lock 10 is a clickable tubular lock, which can provide a simpler structure and lighter weight.

Figure 5:
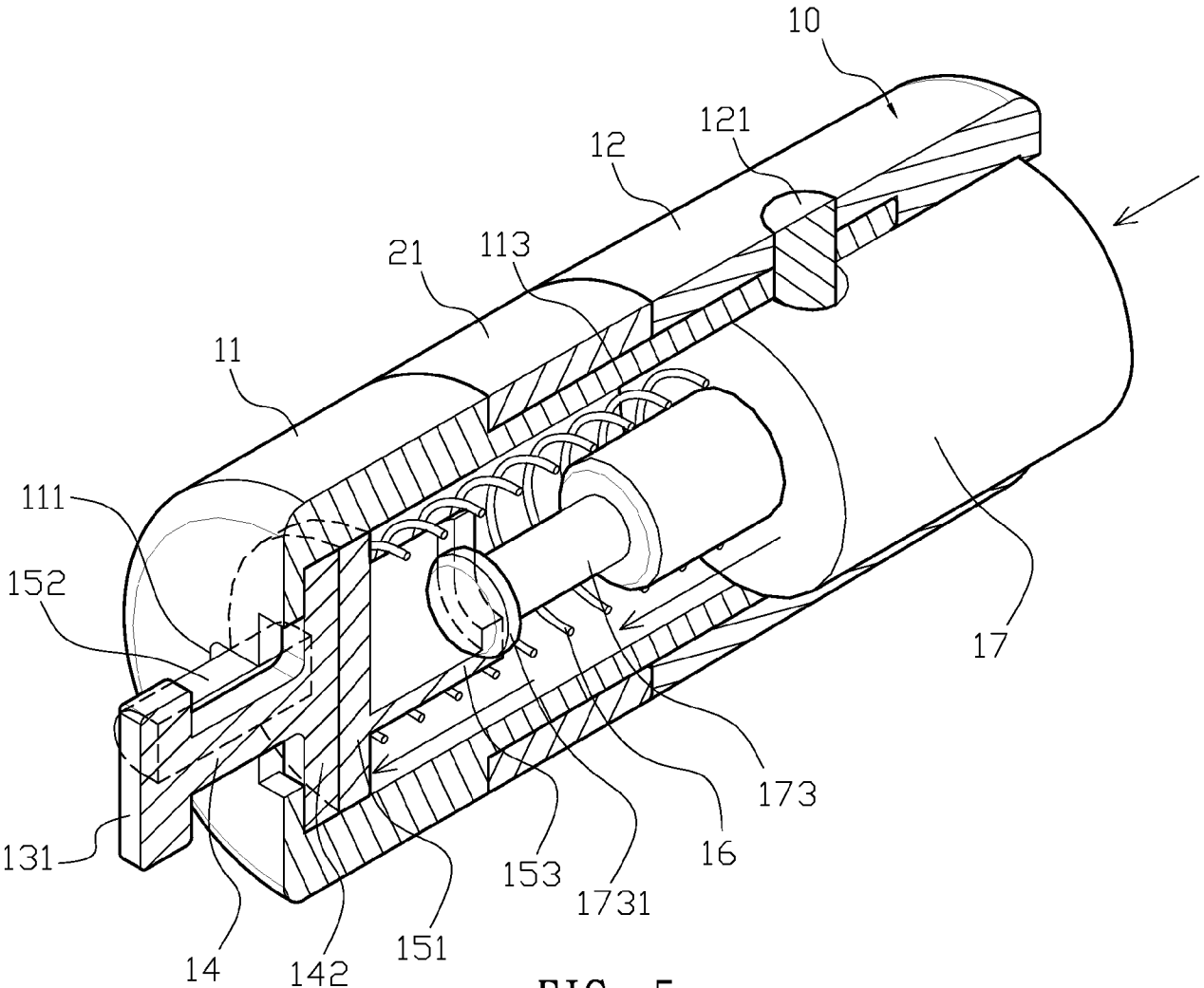
FIG. 5 is another assembly and cross-sectional drawing showing a locking condition according to the embodiment of the present invention.
Figure 6:
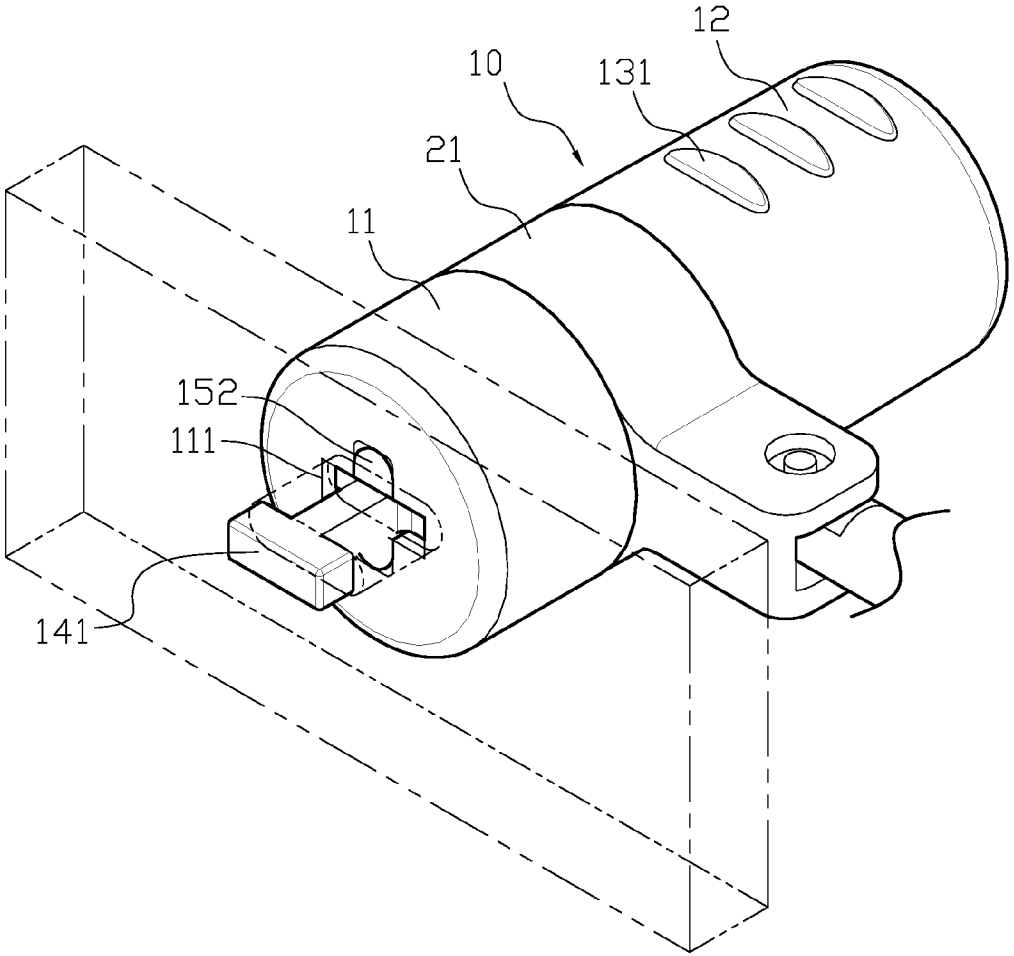
FIG. 6 shows a driving member being pushed by a portable electronic device according to the embodiment of the present invention.
Figure 7:
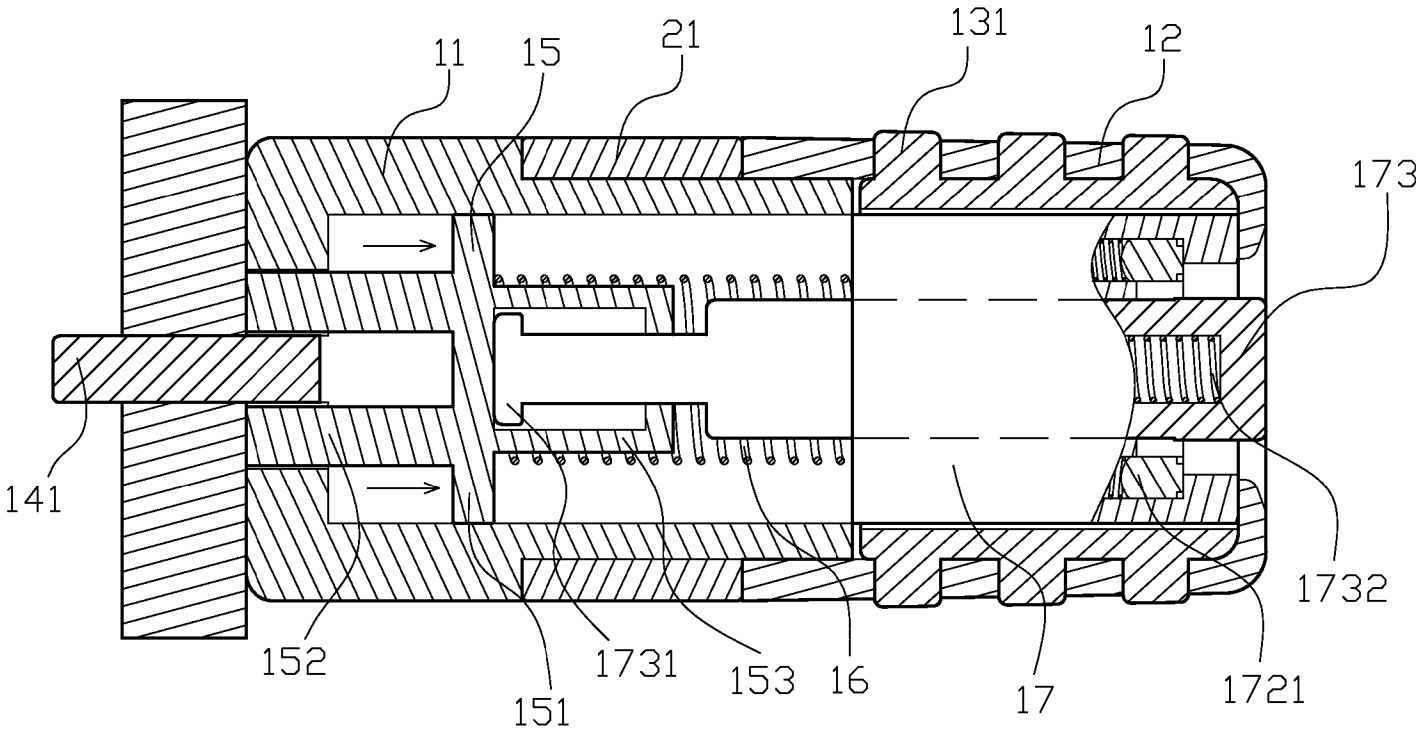
FIG. 7 is a cross-sectional drawing showing the driving member being pushed by a portable electronic device according to the embodiment of the present invention.
Figure 8:
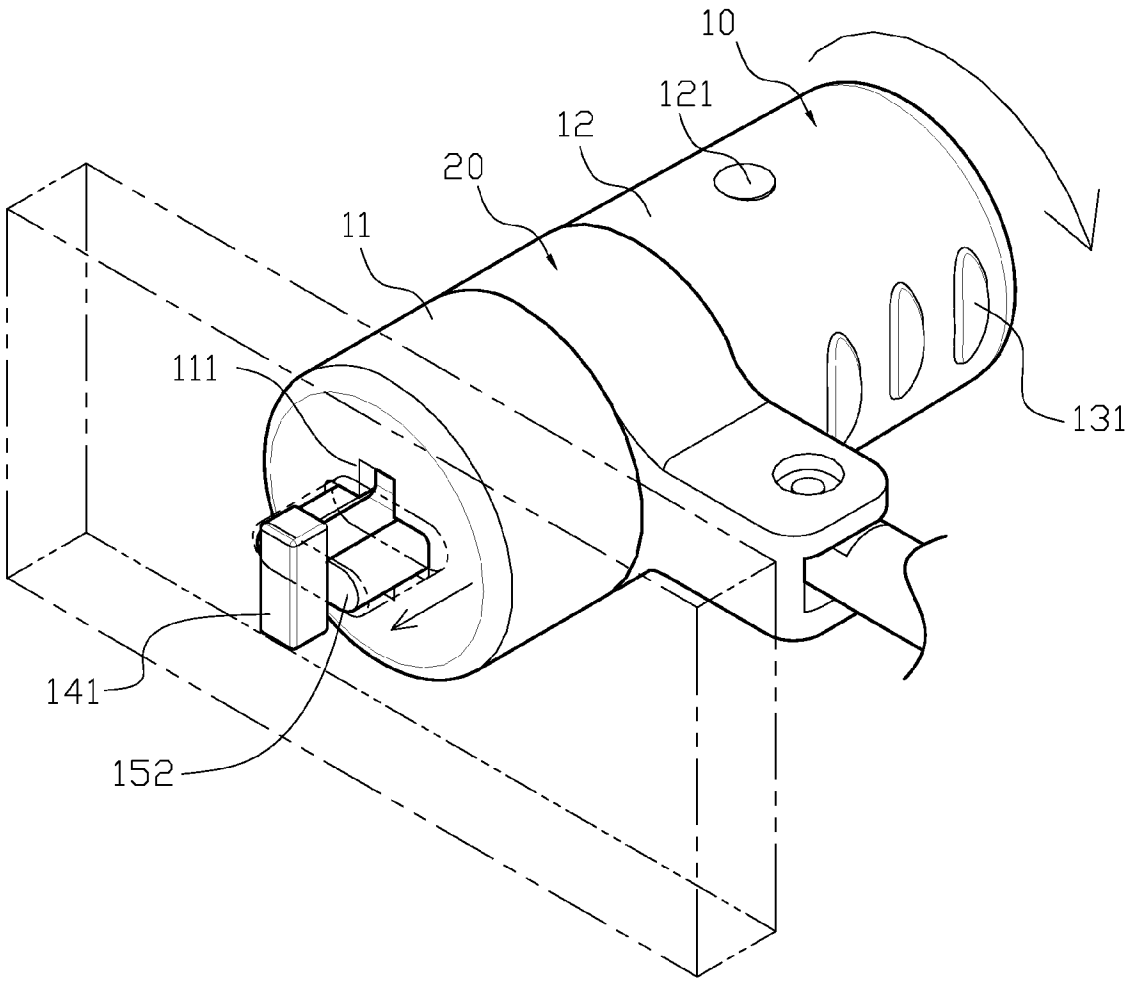
FIG. 8 is a schematic drawing of the embodiment device being attached onto the portable electronic device.
Figure 9:
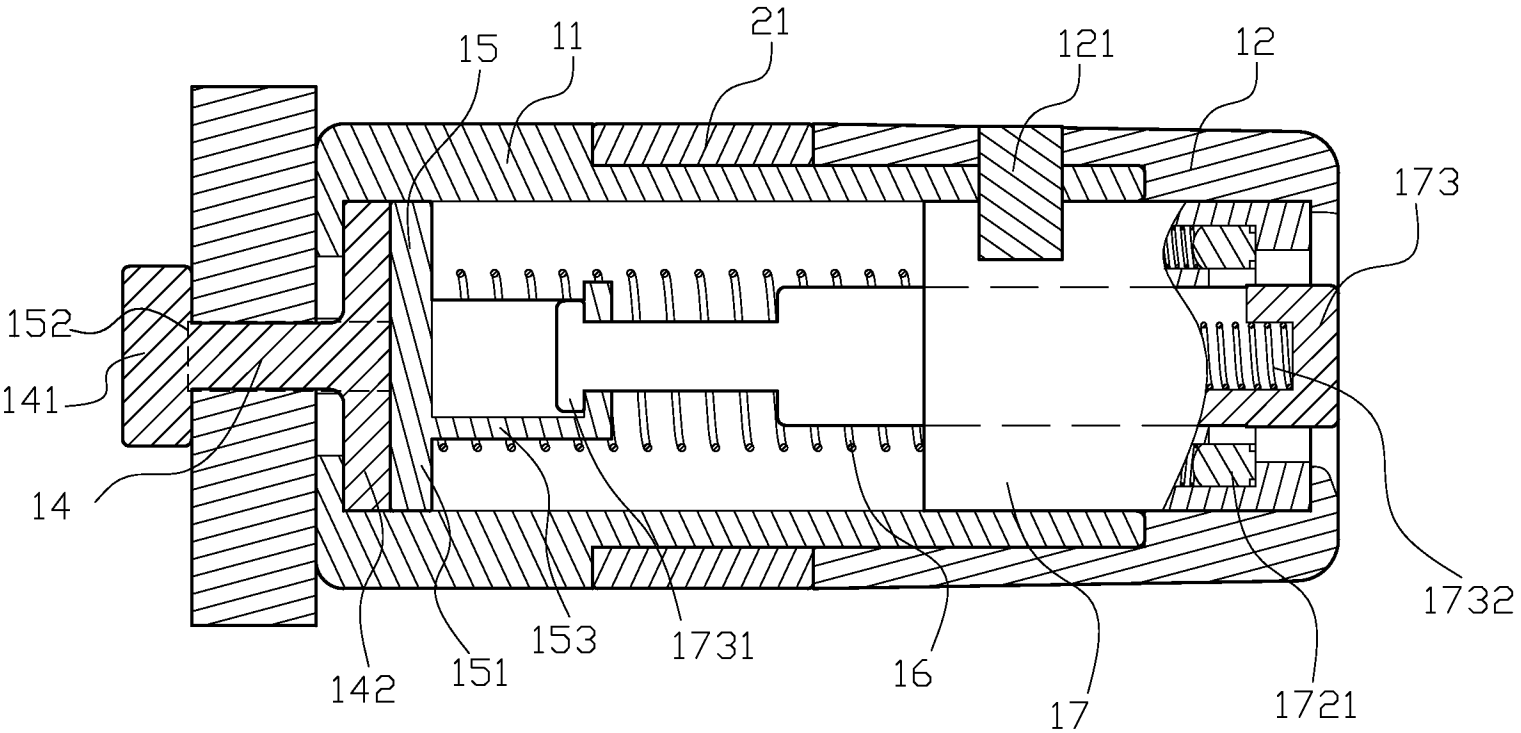
FIG. 9 is a cross-sectional drawing showing the embodiment being locked up according to the present invention.
Figure 10:
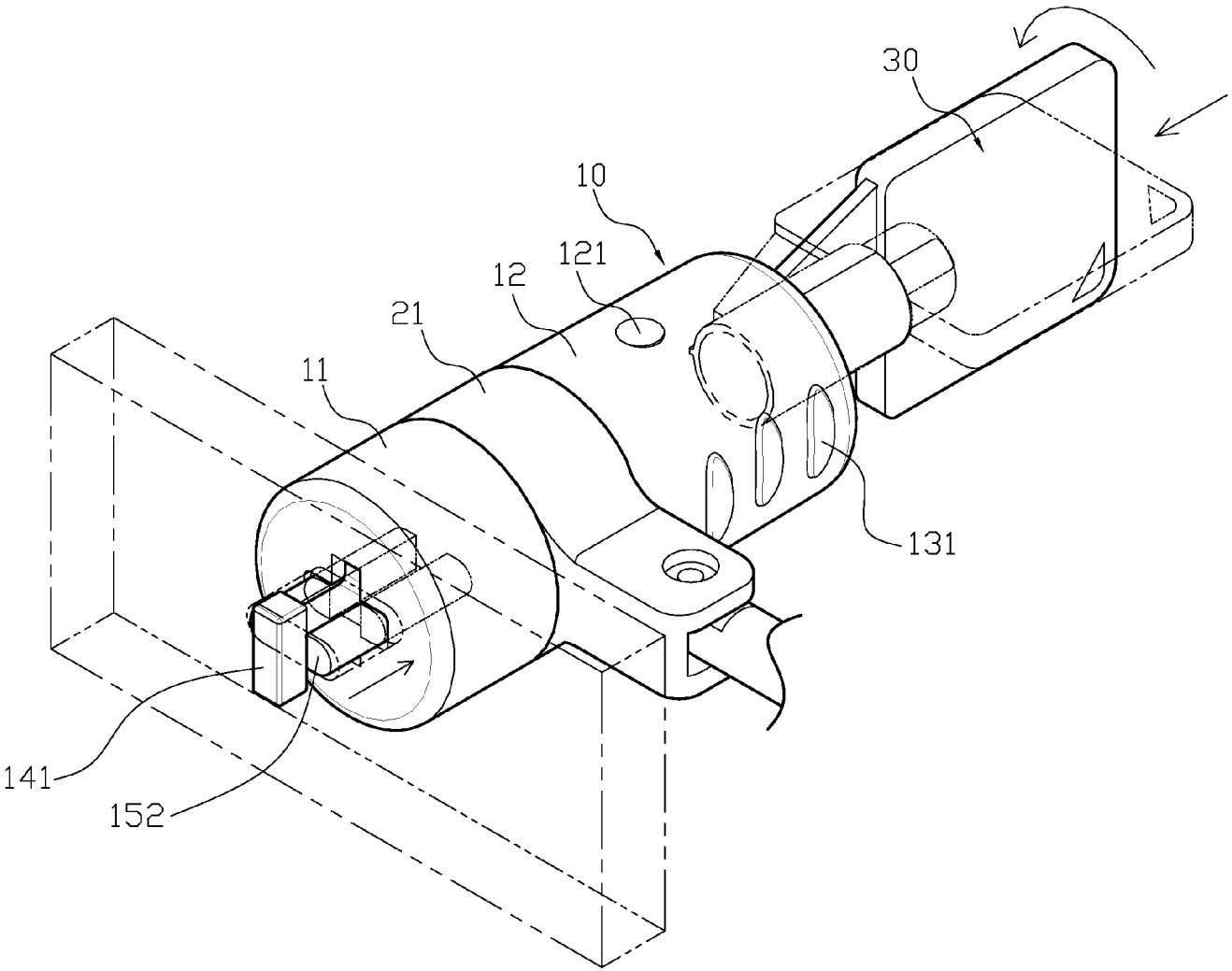
FIG. 10 is a schematic drawing of a key unlocking the embodiment according to the present invention.
Figure 11:
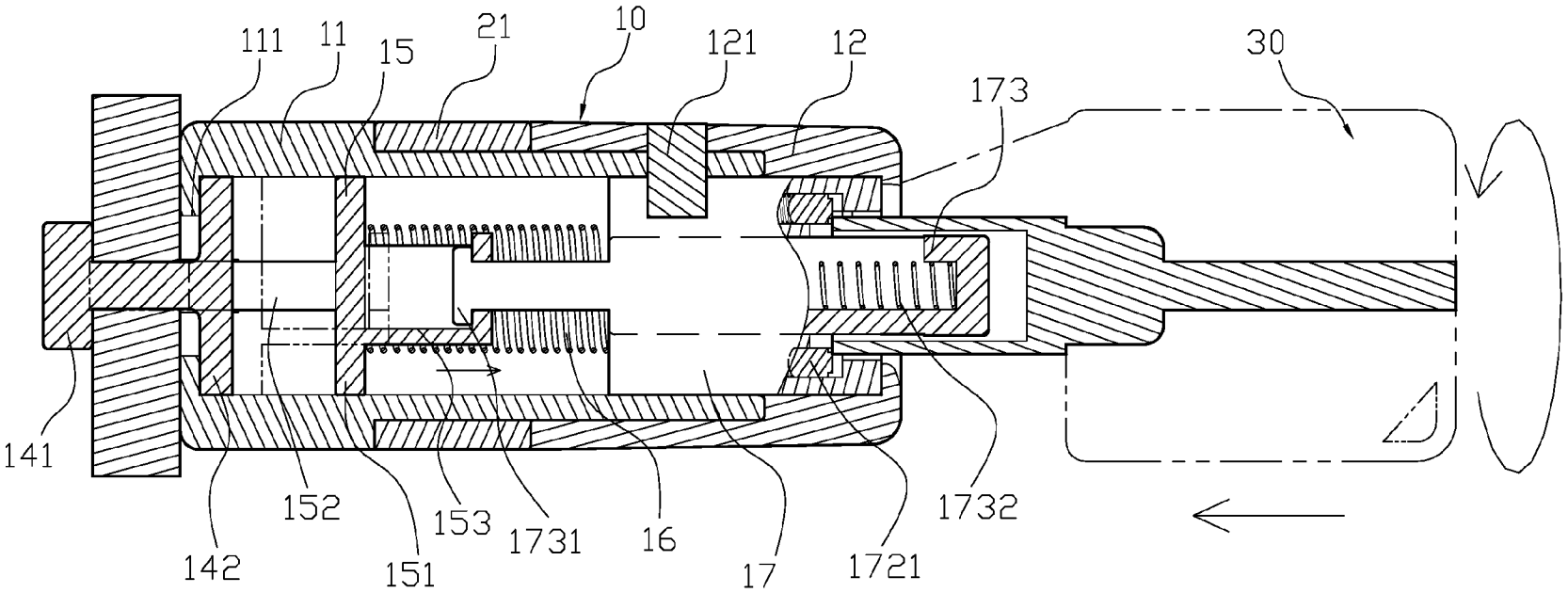
FIG. 11 is a cross-sectional drawing showing the key unlocking the embodiment according to the present invention.

To operate the lock 10, please refer to FIG. 3 with FIGS. 4 and 5. When the sliding rod 173 of the lock core 17 is pressed to the end, the spring 1732 in the groove is compressed, the protruding end 1731 of the sliding rod 173 of the lock core 17 slides along the supporting slot 153 of the driving member 15 and the elastic member 16 is stretched to push against to the disk 151 of the driving member 15, such that the engaging pins 152 of the driving member 15 also move to be adjacent to the opening 11 and the first T-shaped engaging end 141 of the I-shaped engaging member 14. Please further refer to FIGS. 2 and 3 with FIGS. 10 and 11. To unlock the lock 10, a positioning pin 31 of the key 30 needs to be aligned with the positioning slot 1722 of the key hole 172 of the lock core 17, and then the groove 32 of the key 30 engages with the protrusion 1721 of the key hole 172 of the lock core 17 such that the key 30 is able to be rotated. Therefore, the lock core 17 is unlocked and the sliding rod 173 is pushed back by the spring 1732 and utilizes the protruding end 1731 to engage with the supporting slot 153 of the driving member 15, such that the engaging pins 152 of the driving member 15 move back to the opening 111 of the first casing 11 to unlock the lock 10.

Figure 12:
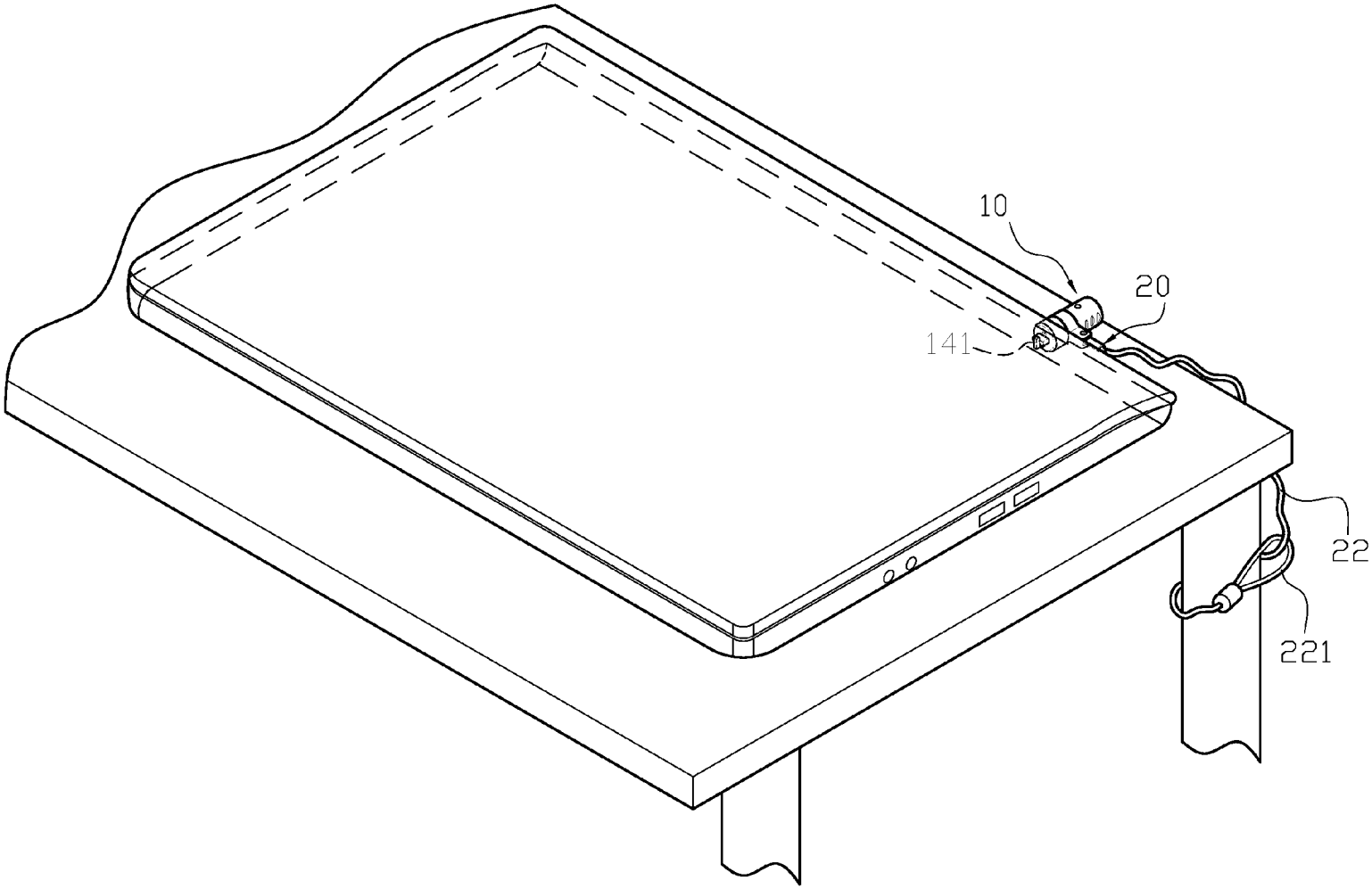
FIG. 12 is a usage schematic drawing of the embodiment according to the present invention.

For actual use, please refer to FIGS. 6, 7, 8, 9 with FIG. 12. The steel cord 22 of the locking cable 20 is first wrapped around a sturdy object, and the lock 10 is passed through the loop 221 of the locking cable 20 and attached to a target object, and then the lock core 17 of the lock 10 is press down to lock. The spring 1732 in the groove is compressed, and the protruding end 1731 of the sliding rod 173 of the lock core 17 slides along the supporting slot 153 of the driving member 15; the elastic member 16 is stretched to push against the disk 151 of the driving member 15 such that the engaging pins 152 of the driving member 15 move adjacent to the opening 111 and the first T-shaped engaging end 141 of the I-shaped engaging member 14. The first T-shaped engaging end 141 of the I-shaped engaging member 14 of the lock 10 is then inserted into a groove on the portable electronic device. Subsequently, the engaging pins 152 of the driving member 15 of the lock 10 are pushed by the sidewall of the portable electronic device to move back into the opening 111 of the first casing 11, such that the disk 151 of the driving member 15 pushes the elastic member 16 and moves adjacent to the protruding end 1731 of the lock core 17. Then, the lock 10 is rotated 90°, such that the opening 111 of the first casing 11 is parallel with the groove of on the sidewall of the portable electronic device, the engaging pins 152 of the driving member 15 are pushed by the elastic member 16, the engaging pins 152 are inserted into the groove on the sidewall of the portable electronic device and against the edge of the groove, and the first T-shaped engaging end 141 of the I-shaped engaging member 14 hooks onto the groove of on the sidewall of the portable electronic device. Since the engaging pins 152 of the driving member 15 push against the edge of the groove on the sidewall of the portable electronic device and adjacent to both sides of the T-shaped engaging end 141 of the I-shaped engaging member 14, the lock 10 is thus unable to be rotated, and the portable electronic device is secured with the sturdy object by way of the steel wire 22 of the locking cable 20. To unlock the lock 10, please refer to FIGS. 2 and 3 with FIGS. 10 and 11. The positioning pin 31 of the key 30 is aligned with and inserted into the positioning slot 1722 of the key hole 172 of the lock core 17. The groove 32 of the key 30 is pushed against the protrusion 1721 of the key hole 172 of the lock core 17 such that the key 30 is able to be rotated. When the lock core 17 is unlocked, the sliding rod 173 is pushed back by the spring 1732, and the sliding rod 173 of the lock core 17 utilizes the protruding end 1731 to drag the supporting slot 153 of the driving member 15 such that the engaging pins 152 of the driving member 15 move back from the opening 111 and the lock 10 is able to be rotated. When the I-shaped engaging member 14 of the lock 10 is rotated to become parallel with the groove of the portable electronic device it can be pulled out.

Figure 13:
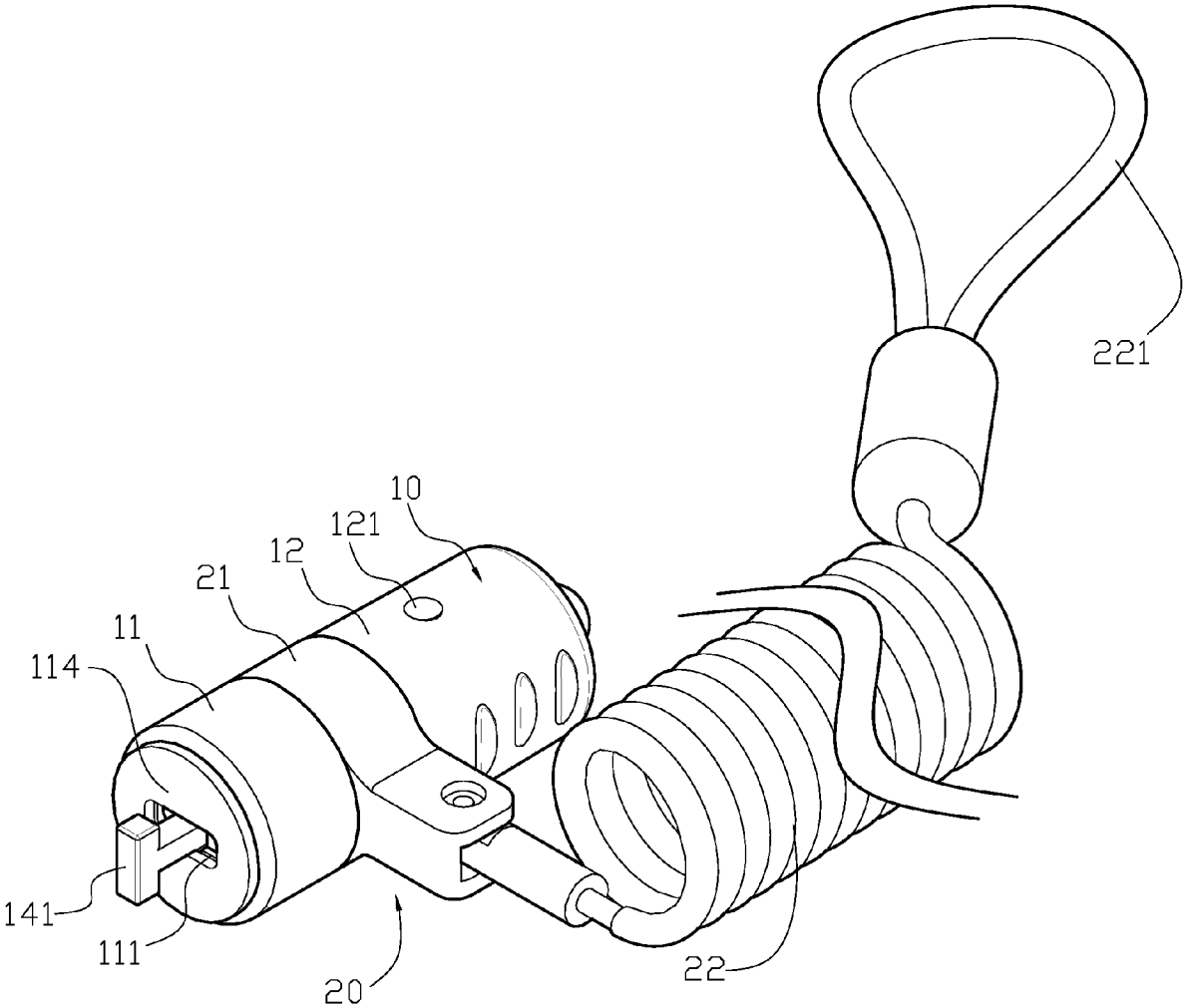
FIG. 13 is a perspective assembly drawing of another embodiment of the present invention.
Figure 14:
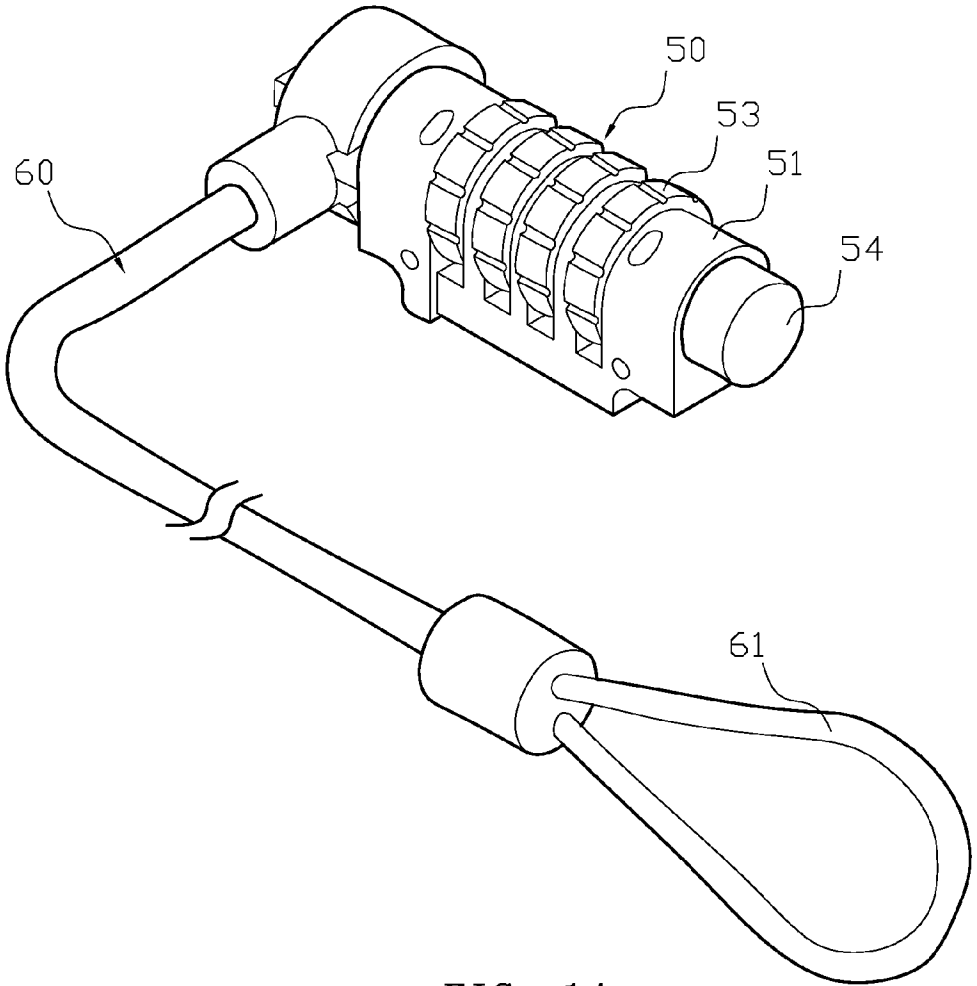
FIG. 14 PRIOR ART
FIG. 14 is a perspective assembly drawing of a prior art.
Figure 15:
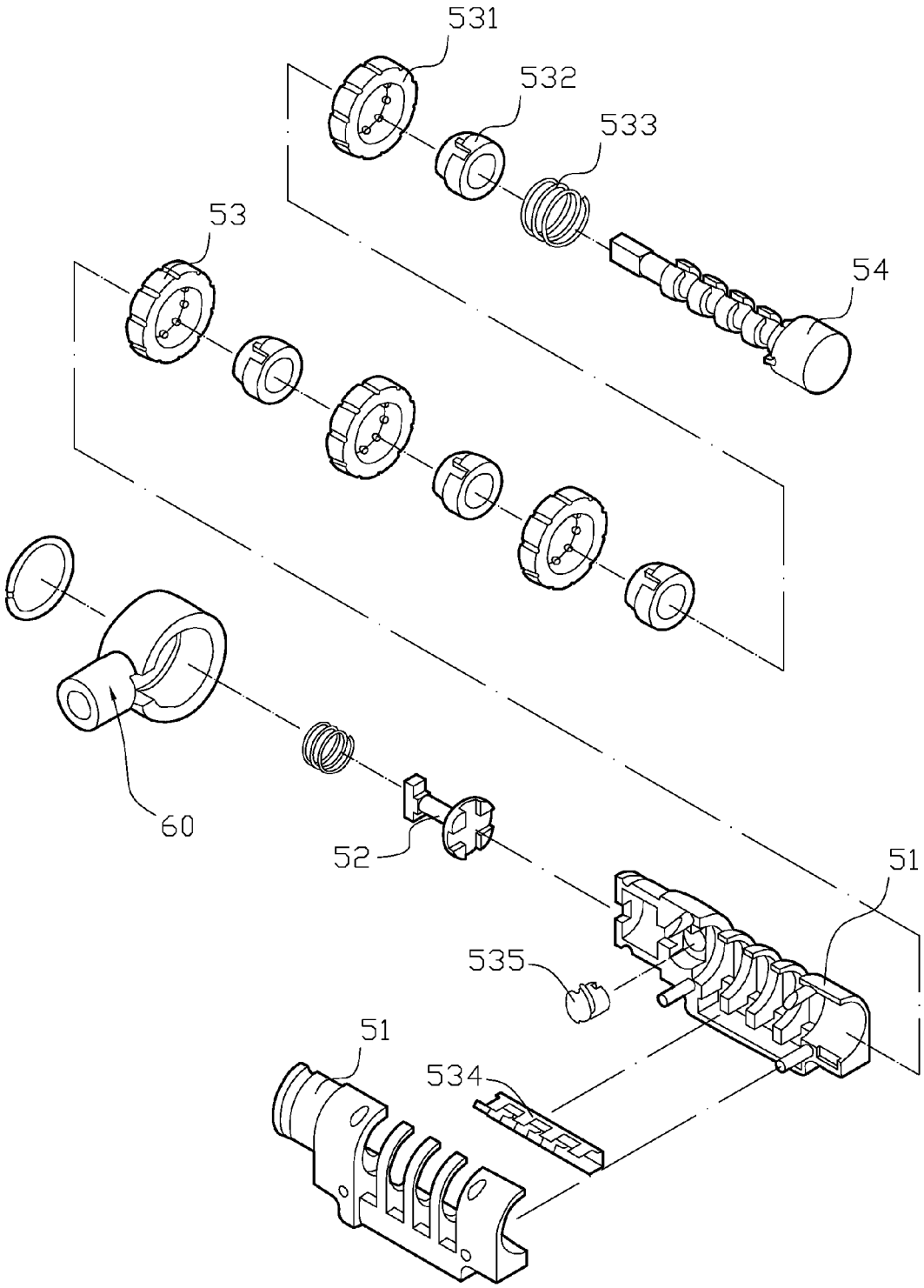
FIG. 15 PRIOR ART
FIG. 15 is a perspective exploded drawing of the prior art.

In addition, as shown in FIG. 13, in another embodiment of the present invention, a pad 114 with a predetermined thickness is disposed around the opening 111 of the first casing 11 of the lock 10, which can fill up a gap between the lock 10 and the portable electronic device.

With the above-mentioned structure, the following benefits can be obtained: 1. The two stoppers 131 of the interlocking member 13 engage with the plurality of limiting openings 122 on two sides of the second casing 12, such that the lock 10 is secured during rotation. 2. The lock core 17 of the lock 10 is a depressible tubular lock, and therefore the key 30 does not need to be rotated to unlock the lock 10. 3. Since the lock core 17 of the lock 10 is a depressible tubular lock, the lock 10 has a simpler structure and a lighter weight. 4. To unlock, the positioning pin 31 of the key 30 is aligned with and inserted into the positioning slot 1722 of the key hole 172 of the lock core 17, and the groove 32 of the key 30 is pushed against the protrusion 1721 of the key hole 172 of the lock core 17 such that the key 30 can be rotated. 5. After the lock 10 is locked, the first T-shaped engaging end 141 of the I-shaped engaging member 14 hooks onto the groove on the sidewall of the portable electronic device; the engaging pins 152 of the driving member 15 push against the edge of the groove on the sidewall of the portable electronic device and adjacent to both sides of the T-shaped engaging end 141 of the I-shaped engaging member 14 and therefore the lock 10 is unable to be rotated; the portable electronic device is thus secured onto a sturdy object by way of the steel wire 22 of the locking cable 20.

Although the present invention has been explained in relation to its preferred embodiment, it is to be understood that many other possible modifications and variations can be made without departing from the spirit and scope of the invention as hereinafter claimed.

What is claimed is:

1. A rotatable lock for a portable electronic device, the lock comprising: a first casing, a second casing, at least two interlocking members, an I-shaped engaging member, a driving member, an elastic member and a lock core; wherein the first casing has a cross-shaped opening on an end, an opening along a direction in the cross-shaped opening further provided with an engaging slot, a connecting section with a smaller cross-sectional area formed adjacent to another end of the first casing, and the connecting section is provided with a through aperture;

the second casing has a circular aperture at an end configured to engage with the connecting section of the first casing, a through aperture on a sidewall for accepting a positioning member and configured to align with the through aperture of the first casing, and a plurality of limiting openings at opposite sides of the side wall for engaging with corresponding stoppers on the at least two interlocking members, wherein the lock core is at least partially disposed between the at least two interlocking members, and the at least two interlocking members are disposed in the second casing;

the I-shaped engaging member has a first T-shaped engaging end at an end and a second T-shaped engaging end at another end, the second T-shaped engaging end configured to engage with the engaging slot of the cross-shaped opening in the first casing and the first T-shaped engaging end is configured to extend through the cross-shaped opening;

the driving member is a disk disposed in the first casing and having at least two parallel engaging pins on one side configured to extend through the cross-shaped opening and a supporting slot on another side;

the elastic member is a spring with a predetermined length engaged between the disk of the driving member and the lock core; and the lock core is a depressible tubular lock having a limiting slot adjacent to a first end, the limiting slot configured to align with the through aperture of the first casing, a key hole on a second end, a sliding rod extending from the first end, the sliding rod provided with a protruding end for engaging with the supporting slot of the driving member.

2. The rotatable lock for a portable electronic device as claimed in claim 1, wherein the second casing has a plurality of pairs of opposing limiting openings for accepting the stoppers on the at least two interlocking members.

3. The rotatable lock for a portable electronic device as claimed in claim 1, wherein the I-shaped engaging member is a rod having a high hardness.

4. The rotatable lock for a portable electronic device as claimed in claim 1, wherein a pad is attached around the opening of the first casing, and the pad is made of a sponge material.

* * * * *